United States Patent [19]

Chen et al.

[11] Patent Number: 4,930,526

[45] Date of Patent: Jun. 5, 1990

[54] MILD CIGA STICK

[76] Inventors: Harlin Chen; Jyh H. Lee, both of 6th Fl., 20, Lane 14 Gi-Lin Rd., (Fei Fong Building), Taipei, Taiwan

[21] Appl. No.: 94,901

[22] Filed: Sep. 10, 1987

[51] Int. Cl.[5] ..... A24B 3/06

[52] U.S. Cl. ..... 131/290; 131/331; 131/342; 131/329

[58] Field of Search ..... 131/331, 290, 329, 342

*Primary Examiner*—V. Millin

*Attorney, Agent, or Firm*—Holman & Stern

[57] ABSTRACT

This invention utilizes the action of Bakuhan Stone for absorbing moisture and producing nicotine decomposition from an ion reaction to make out a device that is put into cigarette packs to absorb and decompose nicotine.

2 Claims, 3 Drawing Sheets

MILD CIGA STICK

BACKGROUND OF THE INVENTION

1. Field of the Invention

This invention relates to cigarette filter systems. Specifically, this invention relates to a cigarette filter made of crushed magnetic Andesite or "Bakuhan" Stone.

2. Description of the Background Art

It is known that nicotine contained in cigarettes is injurious to the human body. The "filter tipped" cigarette was invented to prevent or reduce the injury of nicotine by preventing a part of the nicotine from entering the body when the cigarette is smoked.

Furthermore, when the "filter tip" is full of nicotine, it must be replaced by a new filter tip. This is very inconvenient. Also, when the packaging of cigarettes is broken or when the cigarettes are allowed to sit too long, the cigarettes produce a bad smell from being mildewed. It is an object of the Mild Ciga Stick of this invention to solve the two disadvantages mentioned above.

SUMMARY OF THE INVENTION

The invention is called a "Mild Ciga Stick". The Mild Ciga Stick is filled with Bakuhan Stone and utilizes the effect of the stone of being moisture-absorbing an of decomposing nicotine. This effect produced by Bakuhan Stone is utilized when the stick is placed into a pack of cigarettes.

DESCRIPTION OF THE PREFERRED EMBODIMENT

Figure 1:
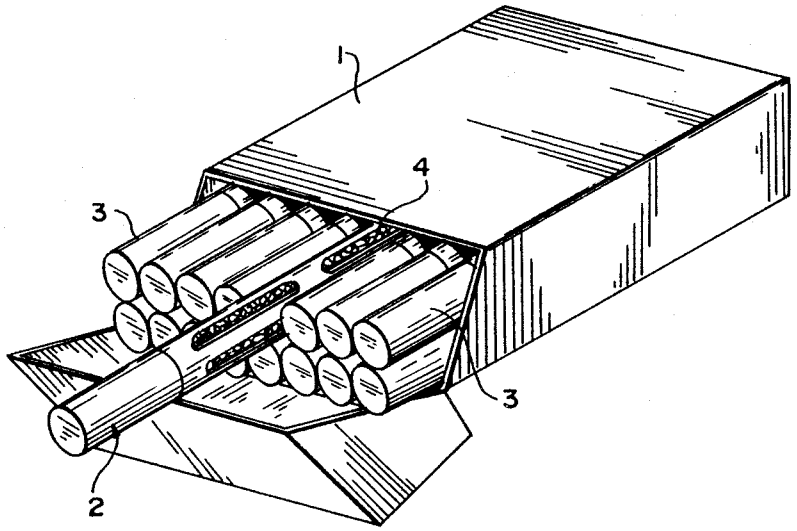
FIG. 1 is the oblique view of a Mild Ciga Stick being put into a cigarette pack.
Figure 2:
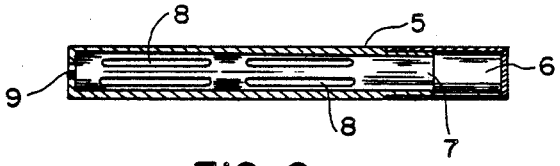
FIG. 2 is the sectional view of the pipe body and pipe cover.
Figure 3:
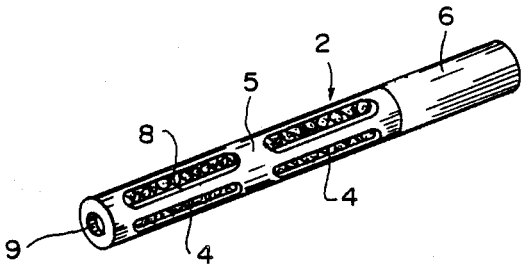
FIG. 3 is the oblique view of Mild Ciga Stick.
Figure 4:
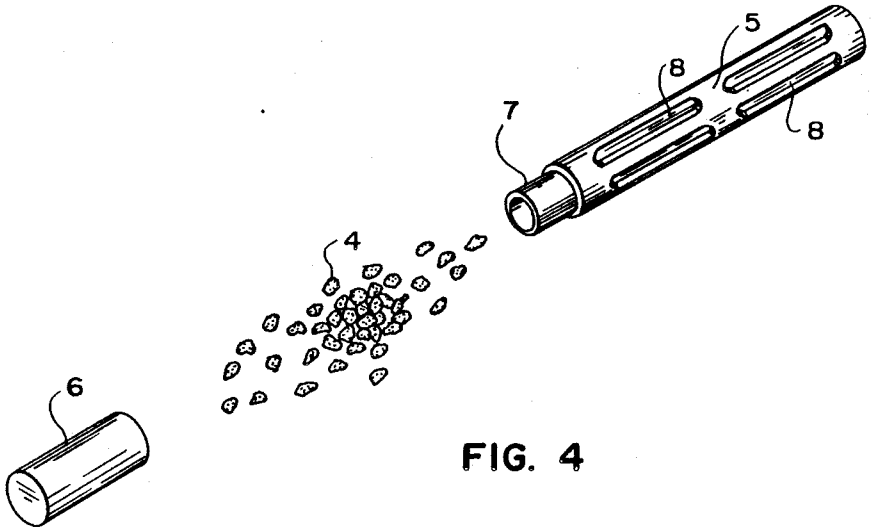
FIG. 4 is the oblique view of Mild Ciga Stick after being loosened.

The "applied example" of this invention is described clearly by referring to the drawings.

FIG. 1 shows the state of placing a Mild Ciga Stick (2) which absorbs moisture and decomposes nicotine into a cigarette container (1). The type of cigarette container used with this invention can vary and is not necessarily the particular cigarette pack as shown in the drawing. All cigarette packs are applicable. The Mild Ciga Stick is desirably the same size as drawn in FIG. 1–FIG. 4 which is the same as general cigarettes in length and diameter but can be changed at will as required. The inner part of the Stick must be filled with Bakuhan Stone (4).

The mild Ciga Stick (2) is composed of pipe body (5) and cover (6). When the pipe body is not covered on the upper end, there is an opening for filling (7) and a lateral long hole (8). The shape of hole can be changed as required, but on the lower wall there is also a round hole (9) which can also be changed as required.

The above description explains the structure of a Mild Ciga Stick.

Bakuhan Stone is a magnetic metal stone. In ancient times, the Book of Plants and Animals of Medicinal Value in China recorded that Bakuhan Stone (4), after being grounded into powder, can be used to cure "hemorrhoid piles". The inventors of Mild Ciga Stick further discovered that Bakuhan Stone, besides medical treatment of hemorrhoid piles, further had the effect of absorbing moisture, mildew-proofing, and decomposing nicotine. The function of decomposing nicotine is produced by the ion reaction produced by Bakuhan Stone (4) to decompose nicotine. After a Mild Ciga Stick (2) is inserted into a cigarette pack (1), only 10 minutes or so are required to develop the effect. The result of this is that only the injury of nicotine is eliminated, but also the unique pungent taste contained in the original nicotine of the cigarette is eliminated, so that the cigarette is smoked more favorably.

Bakuhan Stone (4), also possesses the function of absorption of various materials. Bakuhan Stone absorbs moisture in the air, the alcohol in wine, and the chlorine and impure materials or miscellaneous substance in water. After Bakuhan Stone (4) is powdered or ground to the size shown in FIG. 4, it is filled into a pipe body (5). The pipe body (5) is further assembled to a cover (6) to form the finished product.

The Bakuhan Stone (4) in the finished product must be contained so that the Bakuhan Stone does not fall out of the long hole of the pipe body or hole of various shapes or the round hole on the base part which can have various hole shapes. The Mild Ciga Stick (1) composed of the various parts mentioned above, places Bakuhan Stone (4) in the inner part of a pipe body (5). The ventilation function is provided by the long hole and round hole. The ventilation allows the function of nicotine to decompose and moisture to be eliminated rapidly.

From the applied example mentioned above, it is clearly understood that by putting Bakuhan Stone (4) into the inner part of the invention, for nicotine decomposition and moisture-proofing, the Mild Ciga Stick (2), becomes the finished product. If the main body is made from plastics, the outer shape can simply be changed. Of course, more expensive materials, such as K-gold or copper or other metals, can also be used. Thus, the preferred design of a long cylinder shape for use in cigarette packs is very convenient.

Other desirable shapes besides the Mild Ciga Stick (2) described above can include a bag for better ventilation, a cylinder plate shape, or other shape filled with Bakuhan Stone. The Bakuhan Stone can also be cut into stone pieces.

From this, it may be understood that the chief purpose of this creation is to offer a Mild Ciga Stick in which Bakuhan Stone provides the function of moisture-proofing or absorbing and nicotine decomposition in the cigarette pack. This achieves the objectives of the invention.

We claim:

1. A cigarette filter comprising Bakuhan Stone.

2. A process for preserving cigarettes comprising:

placing Bakuhan Stone in a ventilation Mild Ciga Stick in a cigarette pack containing cigarettes; and storing said Bakuhan Stone in said cigarette pack containing cigarettes for at least about 10 minutes whereby said Bakuhan Stone absorbs moisture in said cigarettes pack and decomposes nicotine.

* * * * *